US007845102B2

(12) United States Patent
Choi

(10) Patent No.: US 7,845,102 B2
(45) Date of Patent: Dec. 7, 2010

(54) MOTION IMAGE ADVERTISING SYSTEM COUPLED WITH ADVERTISING DUMMY

(76) Inventor: Hae-Yong Choi, Mookdong I Park Apartment #108-301, 385 Mook-dong, Jungryang-gu, Seoul-city (KR) 131-768

( * ) Notice: Subject to any disclaimer, the term of this patent is extended or adjusted under 35 U.S.C. 154(b) by 758 days.

(21) Appl. No.: 11/181,916

(22) Filed: Jul. 15, 2005

(65) Prior Publication Data

US 2006/0059743 A1 Mar. 23, 2006

Related U.S. Application Data

(60) Provisional application No. 60/674,714, filed on Apr. 26, 2005.

(51) Int. Cl.
*G09F 15/00* (2006.01)

(52) U.S. Cl. ..... 40/538; 40/560; 353/94

(58) Field of Classification Search ..... 40/538; 361/681, 682; 353/74, 94
See application file for complete search history.

(56) References Cited

U.S. PATENT DOCUMENTS 3,627,926 A * 12/1971 Nichols ..... 348/835
4,084,194 A * 4/1978 Hector ..... 463/34
4,739,567 A * 4/1988 Cardin ..... 40/471
5,363,147 A * 11/1994 Joseph et al. ..... 348/738
5,464,214 A * 11/1995 Griffin ..... 273/148 B
5,564,209 A * 10/1996 Zagnoli ..... 40/594
5,612,741 A * 3/1997 Loban et al. ..... 348/383
5,741,057 A * 4/1998 Goldberg et al. ..... 353/74
5,995,170 A * 11/1999 Ohira et al. ..... 348/836
6,056,406 A * 5/2000 Park ..... 353/94
6,078,848 A * 6/2000 Bernstein et al. ..... 700/237
6,367,934 B1 * 4/2002 Salesky et al. ..... 353/74
D547,757 S * 7/2007 Koo ..... D14/307
2001/0009346 A1 * 7/2001 Waubant ..... 312/304
2004/0211100 A1 * 10/2004 Scherba ..... 40/610
2005/0100210 A1 * 5/2005 Rice et al. ..... 382/162
2005/0248735 A1 * 11/2005 Choi ..... 353/94

* cited by examiner

*Primary Examiner*—Cassandra Davis
(74) *Attorney, Agent, or Firm*—Bacon & Thomas, PLLC

(57) ABSTRACT

A motion image advertising system, coupled with an advertising dummy enlarging an object to be advertised such as a mobile phone, a video camera, or the like, is disclosed. The motion image advertising system includes a screen window and a display apparatus or a flat display installed to the rear side of the screen window and having a screen and a projector. The display apparatus is installed to a support. The support includes a fixing device and an advertising dummy attaching device, respectively installed to the advertising dummy device and the display apparatus to couple and separate the advertising dummy. The advertising dummy and the advertising motion image are simultaneously provided to consumers to increase advertising impact. If necessary, the advertising dummy device can be easily separated from the display apparatus such as the screen to be replaced.

12 Claims, 8 Drawing Sheets

MOTION IMAGE ADVERTISING SYSTEM COUPLED WITH ADVERTISING DUMMY

This application claims priority to provisional application 60/674,714 filed on Apr. 26, 2005 in the United States.

BACKGROUND OF THE INVENTION

1. Field of the Invention

The present invention relates to a model advertising system, and more particularly, to a model advertising system in which a display apparatus is coupled with an advertising dummy, motion images are displayed on a part of the advertising dummy, and, if necessary, the advertising dummy can be coupled with or separated from the display apparatus.

2. Description of the Related Art

Generally, advertising impact is increased when the configuration and motion images of articles are simultaneously shown.

For example, as shown in FIG. 1, the advertising impact is increased by an advertising system, in which an advertising dummy, in which a mobile phone is enlarged to the size of a human and a motion image is displayed on a window of the mobile phone advertising dummy, is installed in front of a shop, a model, in which a video camera has a big size screen installed in a monitor part of the video camera advertising dummy, is installed on the ceiling, or an advertising dummy, in which a scene of a movie or a photo of actor or an actress is enlarged to life size and a screen is installed to a part of the enlarged scene or the advertising dummy of the actor or the actress to display motion images.

However, in a conventional advertising system, the advertising dummy is chiefly manufactured by means of printing and the advertising dummy is not coupled with motion images. Although motion images are coupled with the advertising dummy, since the advertising dummy is expendable, the advertising dummy is destroyed when the advertisement period has elapsed. Meanwhile, though the display apparatus is a durable device, the display device becomes useless as well with the advertising dummy when the advertising dummy is destroyed.

SUMMARY OF THE INVENTION

Therefore, the present invention has been made in view of the above and/or other problems, and it is an object of the present invention to provide a motion image advertising system coupled with an advertising dummy, including an advertising dummy, a display apparatus, and an advertising image system for coupling the advertising dummy with the display apparatus, in which the advertising dummy can be coupled with and separated from the display apparatus, consumers can watch the advertising dummy and the advertising images at the front and rear sides of the advertising image system, since the display apparatus is easily separated from the advertising dummy and can be coupled with another advertising dummy when disposing of the advertising dummy, the display apparatus can be continuously used, and the advertising dummy and the advertising image can be simultaneously displayed in front of, on the ceiling, and in the display window of a shop to increase advertising impact.

In accordance with the present invention, the above and other aspects can be accomplished by the provision of a motion image advertising system, coupled with an advertising dummy of an object to be advertised, for advertising the object, including an advertising dummy device including a screen window and a fixing device installed to the advertising dummy, a display apparatus including a screen installed to the rear side of the advertising dummy device and a projector 5, and an image system coupled with the screen window of the advertising dummy device and including a support to which the display apparatus and an advertising dummy attaching device are coupled such that an advertising image and the advertising dummy are simultaneously provided.

Preferably, the advertising dummy device is coupled with or separated from the image system by the fixing device and the advertising dummy attaching device.

The screen includes a front screen and a rear screen, and the advertising dummy includes a front advertising dummy and a rear advertising dummy.

The display apparatus includes a flat-screen display such as a plasma display panel, a flat-screen monitor, or the like.

BRIEF DESCRIPTION OF THE DRAWINGS

These and/or other aspects and advantages of the present invention will become apparent and more readily appreciated from the following description of the embodiments, taken in conjunction with the accompanying drawings, in which.

DESCRIPTION OF THE PREFERRED EMBODIMENTS

Hereinafter, the preferred embodiments of a motion image advertising system coupled with an advertising dummy according to the present invention will be described in detail with reference to the accompanying drawings.

Figure 1:
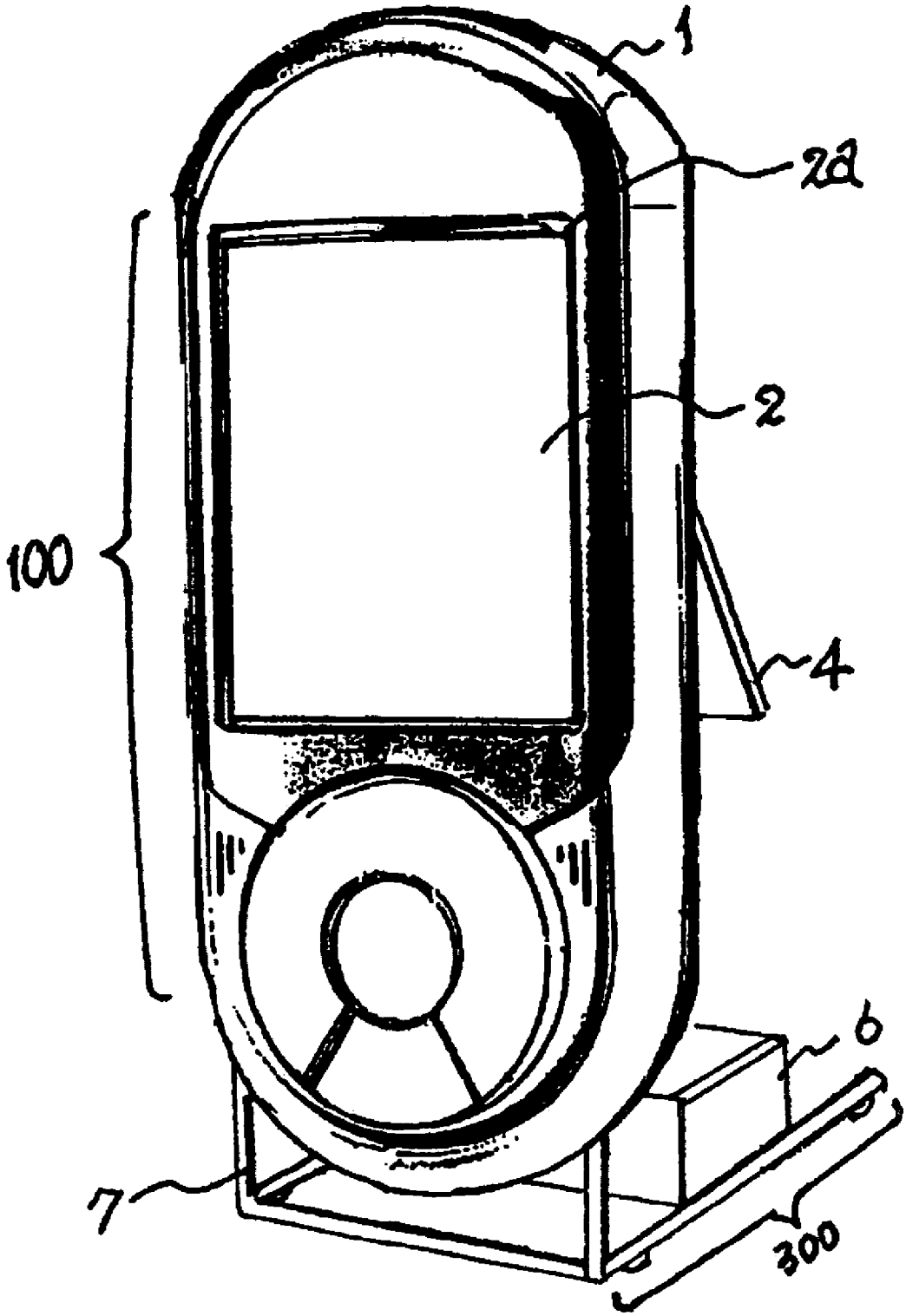
FIG. 1 is a perspective view illustrating a motion image advertising system coupled with an advertising dummy according to a preferred embodiment of the present invention.
Figure 2:
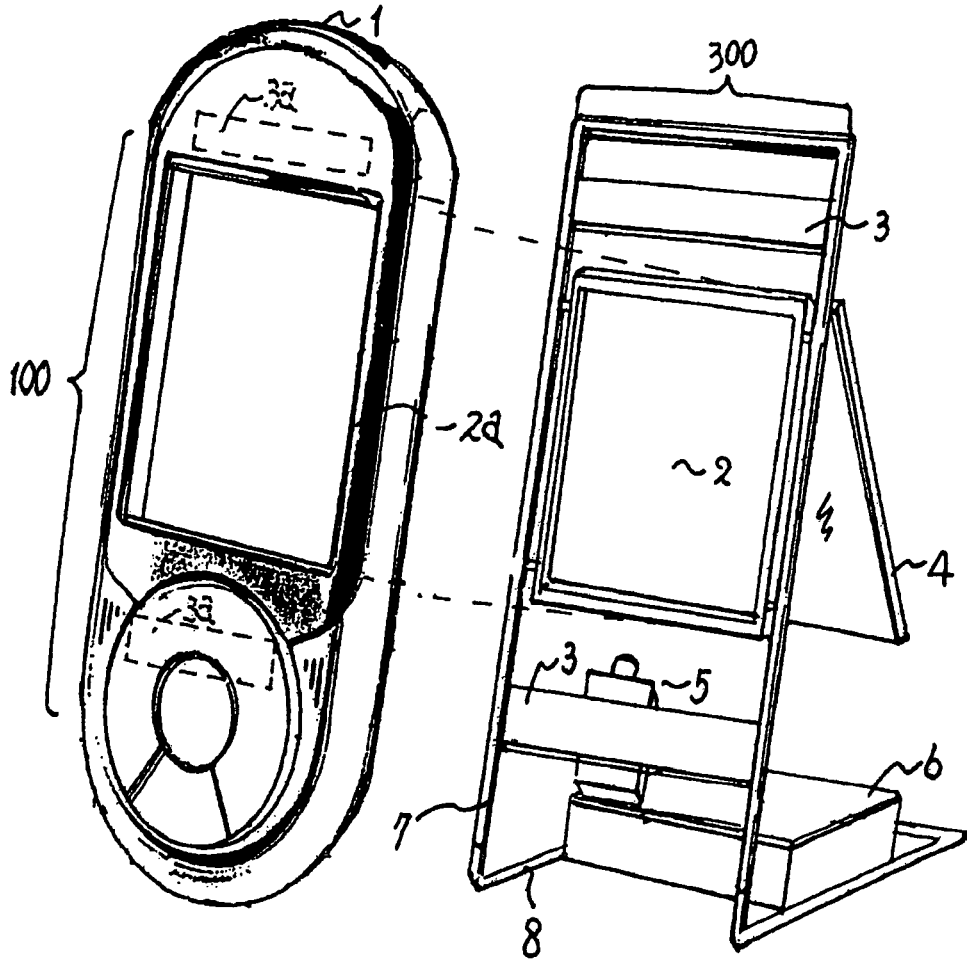
FIG. 2 is an exploded perspective view illustrating the motion image advertising system coupled with an advertising dummy according to the preferred embodiment of the present invention.
Figure 3:
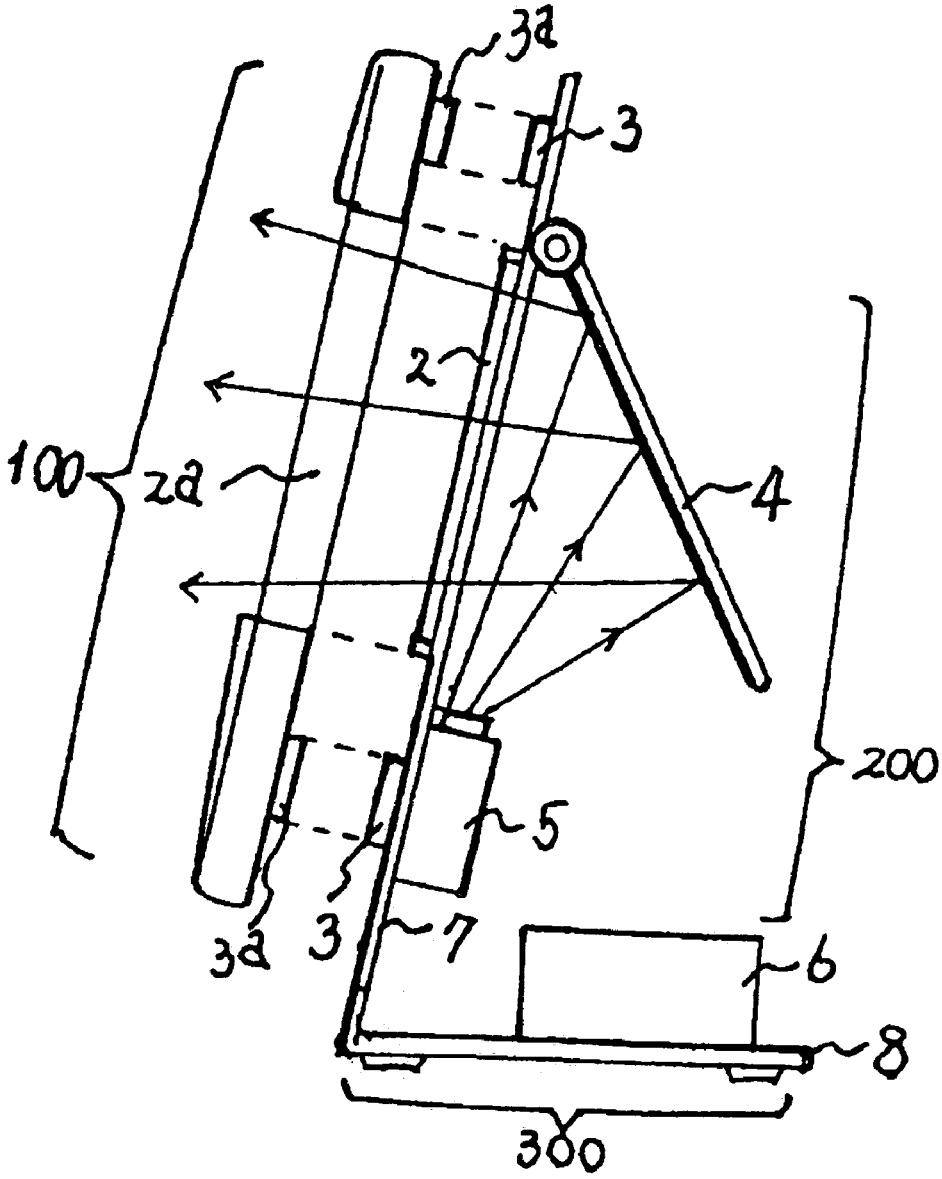
FIG. 3 is an exploded side view illustrating the motion image advertising system coupled with an advertising dummy according to the preferred embodiment of the present invention.

The motion image advertising system coupled with an advertising dummy according to the preferred embodiment of the present invention, as shown in FIGS. 1 to 3, includes an advertising dummy device 100, a display 200, and an image system 300. The advertising dummy device 100 includes an advertising dummy 1 of an object to be advertised, i.e. an enlarged mobile phone, a camcorder, or the like, or a scene of a movie printed in a real size or fabricated by a wooden model, i.e. fabricated in three-dimensions by a mannequin or a plastic model, a screen window 2*a* formed in the advertising dummy 1, and an advertising dummy attaching device 3*a* formed in the rear side of the advertising dummy 1. The display 200 includes a screen 2, a reflecting mirror 4, a projector 5, and an image reproducing device 6 such as a computer, a digital versatile disc (DVD) player. The image system 300 includes a support 7, a crosspiece 8, and a fixing device 3 attached to and separated from a position corresponding to the advertising dummy attaching device 3*a* of the advertising dummy device 100.

In more detail, as shown in FIGS. 1 and 2, the advertising dummy device 100 is manufactured such that the advertising dummy of the object to be advertised such as a new product, for example, an advertising dummy of a mobile phone is manufactured to life size, the screen window 2*a* is formed in the advertising dummy, and the advertising dummy attaching device 3*a* is installed to the upper and lower sides of the screen window 2*a*.

The crosspiece 8 is coupled with the lower side of the support 7 slightly inclined from a vertical axis and the transparent screen 2 is installed to the upper side of the support 7.

The advertising dummy attaching device 2*a* is installed to the upper and lower sides of the screen 2 to correspond to the position of the fixing device 3 installed to the advertising dummy device 100.

The advertising dummy attaching device 3*a* and the fixing device 3 are implemented by a device for attaching to and detaching from each other such as a velcro, a double-sided adhesive tape, or the like. The projector 5 is installed to the lower side of the support 7 and the reflecting mirror 4 is installed to the rear side of the screen 2 of the support 7 so that the display 200 is coupled with the image system 300.

As such, the image system 300 coupled with the display 200 is coupled with the advertising dummy device 100. The screen 2 of the display 200 is coupled with the screen window 2*a* of the advertising dummy device 100 and the advertising dummy attaching device 3*a* is coupled with the fixing device 3 so that the display 200 is coupled with the advertising dummy device 100.

After using the motion image advertising system according to the preferred embodiment of the present invention, when only the advertising dummy device 100 is separated from the screen 2 of the display apparatus, the removed advertising dummy device 100 can be replaced with a new advertising dummy device.

In the motion image advertising system coupled with an advertising dummy according to the preferred embodiment of the present invention, an image signal outputted from the DVD player, the computer, or the like is inputted to the projector 5 and the image projected by the projector 5 is formed on the screen after being reflected by the reflecting mirror 4.

The advertising dummy 1 can be attached to or separated from the screen 2 by the screen window 2*a* of the advertising dummy 1 and the fixing device 3 around the screen 2 of the display 200.

Therefore, in the motion image advertising system coupled with an advertising dummy according to the preferred embodiment of the present invention, the screen window 2*a* formed in the advertising dummy 1 is coupled with the screen 2 of the display 200 by the fixing device 3 and the advertising dummy attaching device 3*a* so that the motion image advertising system simultaneously provides the advertising dummy and the advertising image to consumers to increase the advertising impact of the object to be advertised, and if necessary, the advertising dummy 1 is separated from the display 200 to be replaced another advertising dummy.

Figure 4:
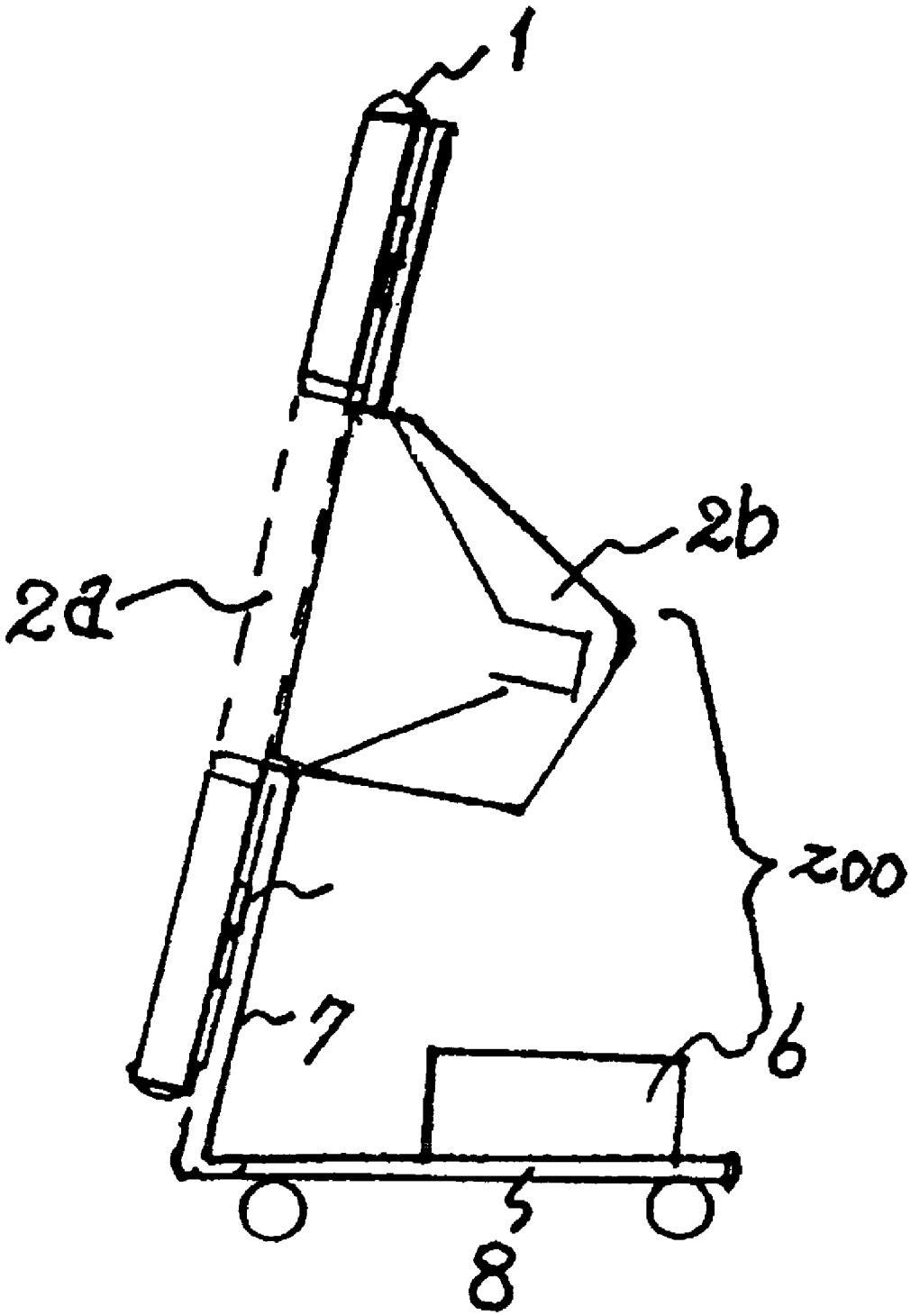
FIG. 4 is a side view of the assembly of the motion image advertising system coupled with an advertising dummy according to the preferred embodiment of the present invention.
Figure 5:
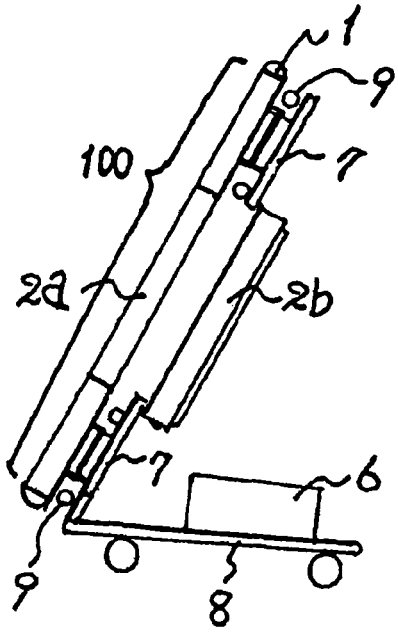
FIG. 5 is a side view of the assembly of the motion image advertising system coupled with an advertising dummy and having an illuminating device according to the preferred embodiment of the present invention.

In the motion image advertising system coupled with an advertising dummy according to the preferred embodiment of the present invention, as shown in FIG. 4, the display 200 including the screen 2 and the projector 5 may be replaced with a flat-screen display 2*b* such as a flat-screen monitor, a liquid crystal display (LCD), a plasma display panel (PDP), or the like. Moreover, as shown in FIG. 5, when an illuminating device 9 is installed between the advertising dummy device 100 and the support 7 and the advertising dummy 1 is made of a transparent plastic, a high brightness advertising dummy 1 can be implemented.

Figure 6:
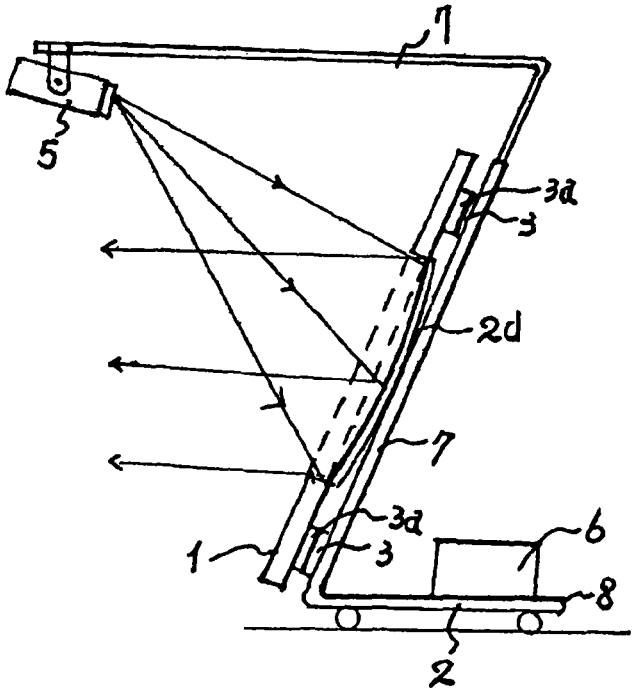
FIG. 6 is a side view of the assembly of the motion image advertising system coupled with an advertising dummy and having a screen, according to the preferred embodiment of the present invention.
Figure 10:
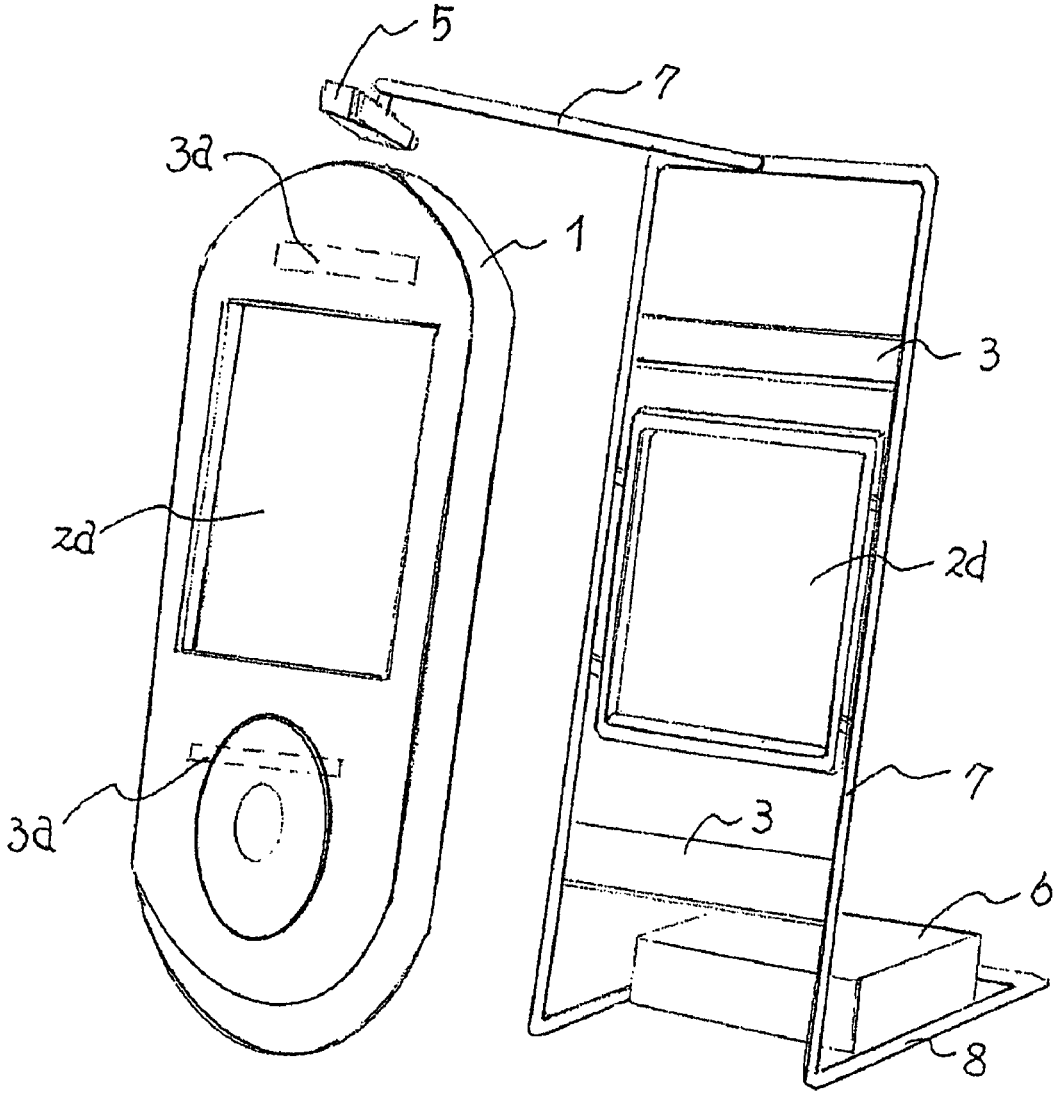
FIG. 10 is another view of the assembly of the motion image advertising system and an advertising dummy according to a preferred embodiment of the present invention.

As shown in FIG. 6 and FIG. 10, the screen may be made of a reflective screen 2*d* and the projector 5 may be installed outside of the display 200 or to the support 7.

In this case, the motion image advertising system according to the preferred embodiment of the present invention can provide a high brightness image and a high brightness advertising dummy 1 due to the reflective screen 2*d*, simultaneously.

Figure 7:
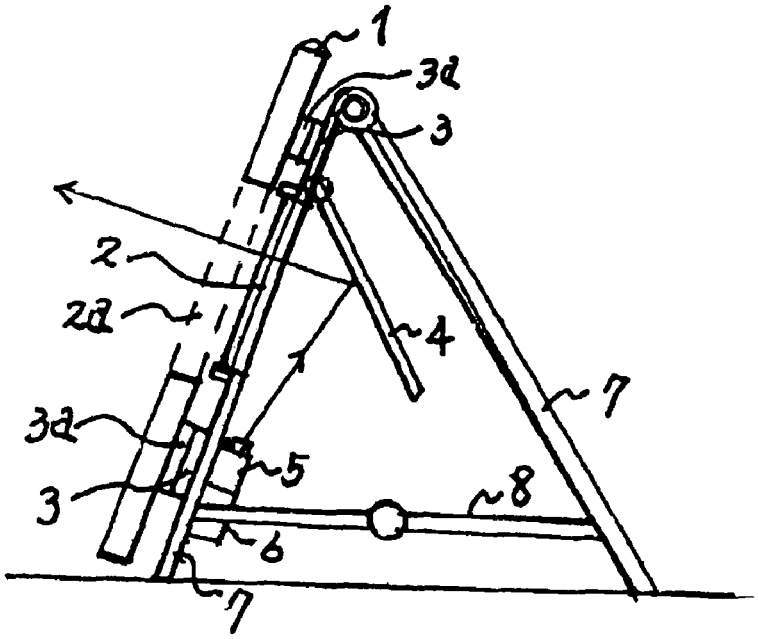
FIG. 7 is a side view illustrating a folding structure of the motion image advertising system coupled with an advertising dummy according to the preferred embodiment of the present invention.

As shown in FIG. 7, the support 7 has a foldable structure. The projector 5 is installed to the lower side of the support 7, the foldable reflecting mirror 4 is installed to the upper side of the support 7, the transparent screen 2 is installed to the front side of the support 7, and the crosspiece 8 also has a foldable structure. In this case, since the support 7, the crosspiece 8, and the reflecting mirror 4 can be folded, the motion image advertising system coupled with an advertising dummy according to the preferred embodiment of the present is convenient to transport and store.

Figure 8:
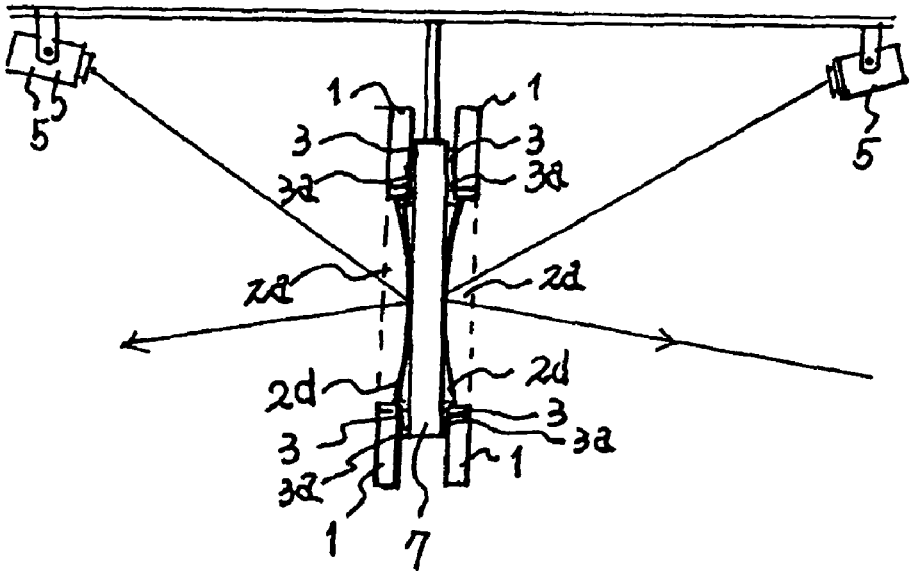
FIG. 8 is a side view illustrating front and rear screens of the motion image advertising system coupled with an advertising dummy according to the preferred embodiment of the present invention mounted on the ceiling.

As shown in FIG. 8, although the screen is implemented by the reflective screen 2*d*, the reflective screen 2*d* may be installed to the front and rear sides of the support 7 to form a double-faced screen and the projector 5 and the advertising dummy 1 may be installed before and behind the screen.

Figure 9:
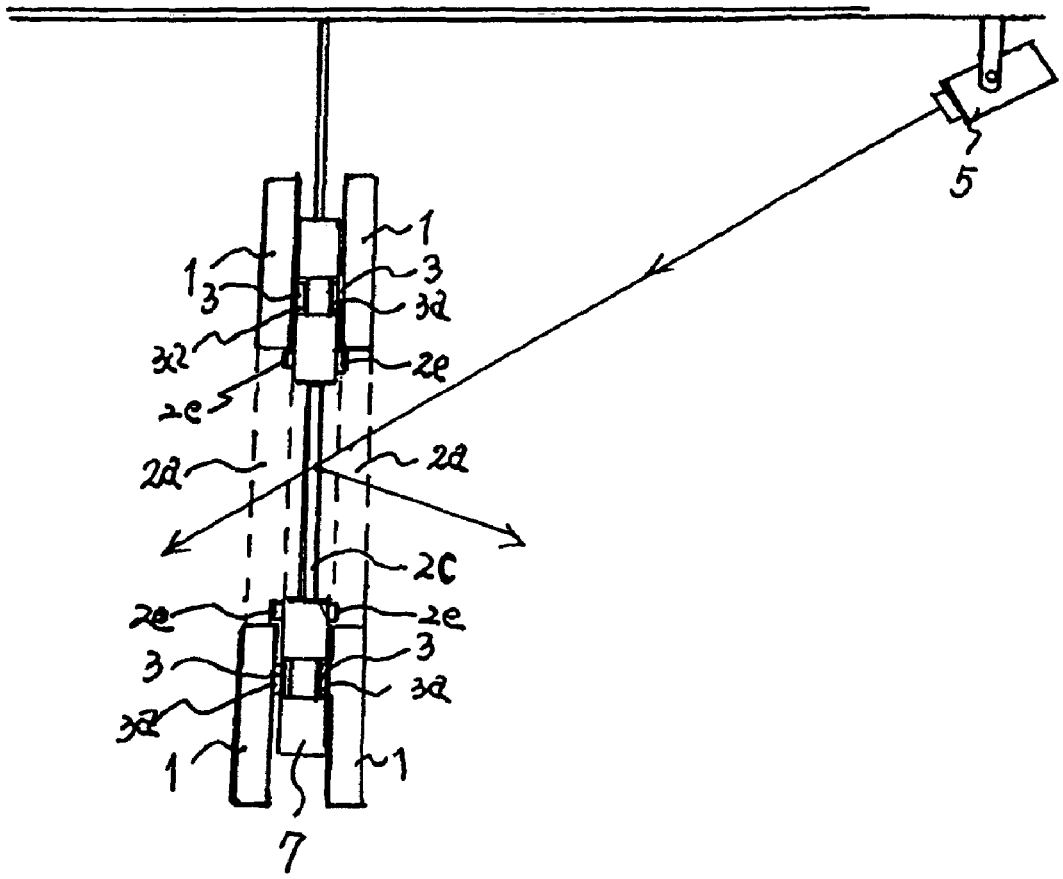
FIG. 9 is a side view illustrating the installation of a double-faced screen of the motion image advertising system coupled with an advertising dummy according to the preferred embodiment of the present invention.

As shown in FIG. 9, the screen 2 is made of a double-faced screen 2*c* having 50% permeability and 50% reflectance and the advertising dummy 1 is installed to front and rear frames 2*e* of the double-faced screen 2*c*.

In this case, the projector 5 is installed on the ceiling or to a separate projector mount.

When the motion image advertising system coupled with an advertising dummy according to the preferred embodiments of the present invention shown in FIG. 8 is installed on the street where there are many passersby, since consumers in front of or behind the motion image advertising system according to the preferred embodiments of the present invention can watch the motion image, the advertising impact increased.

According to the motion image advertising system coupled with an advertising dummy according to the preferred embodiments of the present invention shown in FIG. 9, consumers in front of and behind the motion image advertising system of the present invention can view the motion image displayed on a single screen and by a single projector 5 simultaneously, the advertising impact is also increased.

All of the motion image advertising systems coupled with an advertising dummy as shown in FIGS. 4 to 9 are identical to the principle of the motion image advertising systems shown in FIGS. 1 to 3 in which the advertising dummy device 100 is coupled with the image system 300 to be installed to one or both of the front and rear sides of the motion image advertising system according to the present invention such that the advertising dummy and the advertising motion image can be simultaneously provided, and if necessary, the display 200 such as the screen 2 is coupled with or separated from the advertising dummy 1.

Moreover, when an illuminating device 9 is installed between the advertising dummy device 100 and the display 200, i.e. to the front side of the display apparatus and the advertising dummy 1 is made of a transparent material, a bright advertising dummy can be provided.

As described above, according to the motion image advertising system according to the present invention, the advertising motion image displayed on the screen 2 and the advertising dummy 1 can be simultaneously provided to consumers, and the consumers can watch the advertising motion image displayed on the front and rear sides of the screen 2 and the advertising dummy 1 when the motion image advertising system is installed on the ceiling. Moreover, since the advertising dummy 1 can be coupled with or separated from the screen 2 at any time, various advertising dummies of objects to be advertised can be replaced and advertised.

In addition, in the motion image advertising system coupled with an advertising dummy according to the present invention, since a large scaled screen such as a transparent screen, a reflective screen, a double-faced screen, or the like can be implemented by a projector 5, a super sized advertising dummy device 100 can be implemented and the super sized advertising dummy device 100 can be coupled with a flat-panel display 2*b* such as a flat-screen monitor, a plasma display panel, or the like. Therefore, the motion image advertising system coupled with an advertising dummy according to the present invention can provide an advertising dummy 1 enlarging electronic goods such as a mobile phone, a camcorder, or the like, an advertising dummy of a scene of a movie or a play, sporting goods, a vehicle, or the like, and an advertising motion image thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A motion image advertising system, coupled with an advertising dummy of an object to be advertised, for advertising the object comprising:

an advertising dummy device including a screen window and an attaching device which are installed to a portion of the advertising dummy device; and a support including a reflection screen, a projector and a fixing device wherein the fixing device and the attaching device are to be coupled with or separated from each other and wherein reflection screens are provided on front and rear surfaces of the support, and advertising dummies are provided on front and rear surfaces of the support wherein an illuminating device is installed between the advertising dummy device and the support and the advertising dummy device is made of a transparent plastic.

2. The motion image advertising system, coupled with an advertising dummy of an object to be advertised, for advertising the object as set forth in claim 1, wherein the advertising dummy is an enlarged mobile phone, a camcorder, a scene of a movie printed in real size or fabricated by a wooden model or fabricated in three-dimensions by a mannequin or a plastic model, an enlarged electronic device, scene from a play, sporting goods, or a vehicle.

3. The motion image advertising system, coupled with an advertising dummy of an object to be advertised, for advertising the object as set forth in claim 1, wherein the attaching device is formed in the rear of the advertising dummy and installed to upper and lower sides of the screen window.

4. The motion image advertising system, coupled with an advertising dummy of an object to be advertised, for advertising the object as set forth in claim 1, wherein the advertising dummy is life-sized.

5. The motion image advertising system, coupled with an advertising dummy of an object to be advertised, for advertising the object as set forth in claim 1, wherein the attaching device and the fixing device are attached or detached from each other by sticky tape.

6. The motion image advertising system, coupled with an advertising dummy of an object to be advertised, for advertising the object as set forth in claim 1, wherein the advertising dummy is removed and replaced with another advertising dummy.

7. The motion image advertising system, coupled with an advertising dummy of an object to be advertised, for advertising the object as set forth in claim 1, wherein the support, a reflecting mirror and a crosspiece are foldable.

8. The motion image advertising system, coupled with an advertising dummy of an object to be advertised, for advertising the object as set forth in claim 1, wherein the reflection screens form a doubled-faced screen.

9. The motion image advertising system, coupled with an advertising dummy of an object to be advertised, for advertising the object as set forth in claim 8, wherein the double-faced screen has 50% permeability and 50% reflectance and the advertising dummies are installed to front and rear frames of the double-faced screen.

10. The motion image advertising system, coupled with an advertising dummy of an object to be advertised, for advertising the object as set forth in claim 9, wherein a projector is installed on a ceiling or on a separate projector mount.

11. The motion image advertising system, coupled with an advertising dummy of an object to be advertised, for advertising the object as set forth in claim 1, further comprising an image reproducing device such that an image signal is outputted from the image reproducing device and inputted to the projector and an image projected by the projector is formed on the screen after being reflected by a reflecting mirror.

12. The motion image advertising system, coupled with an advertising dummy of an object to be advertised, for advertising the object as set forth in claim 1, wherein the screen and projector are replaced with a flat-screen monitor including a Liquid Crystal Display (LCD) or a Plasma Display Panel (PDP).

* * * * *